US006684404B2

(12) United States Patent
Bachner, Jr. et al.

(10) Patent No.: US 6,684,404 B2
(45) Date of Patent: Feb. 3, 2004

(54) MULTI-COMPONENT STAB AND BALLISTIC RESISTANT GARMENT AND METHOD

(75) Inventors: Thomas E. Bachner, Jr., Eastport, MI (US); Mark S. Pickett, Kewadin, MI (US)

(73) Assignee: Second Chance Body Armor, Inc., Central Lake, MI (US)

( * ) Notice: Subject to any disclaimer, the term of this patent is extended or adjusted under 35 U.S.C. 154(b) by 227 days.

(21) Appl. No.: 09/930,083

(22) Filed: Aug. 15, 2001

(65) Prior Publication Data

US 2002/0073473 A1 Jun. 20, 2002

Related U.S. Application Data

(60) Provisional application No. 60/225,553, filed on Aug. 16, 2000.

(51) Int. Cl.[7] ..... F41H 1/02; F41H 1/04

(52) U.S. Cl. ..... 2/2.5; 429/911; 442/232; 442/234

(58) Field of Search ..... 2/2.5; 428/911; 442/232, 234

(56) References Cited

U.S. PATENT DOCUMENTS

| | | | | |
|---|---|---|---|---|
| 4,608,717 A | | 9/1986 | Dunbavand | |
| 4,989,266 A | | 2/1991 | Borgese et al. | |
| 5,185,195 A | | 2/1993 | Harpell et al. | |
| 5,196,252 A | | 3/1993 | Harpell | |
| 5,198,280 A | | 3/1993 | Harpell et al. | |
| 5,254,383 A | | 10/1993 | Harpell et al. | |
| 5,316,820 A | | 5/1994 | Harpell et al. | |
| 5,327,811 A | | 7/1994 | Price et al. | |
| 5,349,893 A | | 9/1994 | Dunn | |
| 5,472,769 A | * | 12/1995 | Goerz et al. | 428/138 |
| 5,479,659 A | | 1/1996 | Bachner, Jr. | |
| 5,565,264 A | | 10/1996 | Howland | |
| 5,578,358 A | | 11/1996 | Foy et al. | |
| 5,589,254 A | | 12/1996 | Dischler | |
| 5,619,748 A | | 4/1997 | Nelson et al. | |
| 5,622,771 A | | 4/1997 | Chiou et al. | |
| 5,724,670 A | | 3/1998 | Price | |
| 5,918,309 A | * | 7/1999 | Bachner, Jr. | 2/2.5 |
| 5,960,470 A | | 10/1999 | Bachner, Jr. | |
| 6,131,193 A | * | 10/2000 | Bachner, Jr. | 2/2.5 |
| 6,154,880 A | | 12/2000 | Bachner, Jr. | |
| 6,159,590 A | * | 12/2000 | Kim | 428/223 |
| 6,189,157 B1 | * | 2/2001 | Ziegler | 2/455 |
| 6,219,842 B1 | | 4/2001 | Bachner, Jr. | |
| 6,240,557 B1 | * | 6/2001 | Bachner, Jr. | 2/2.5 |
| 6,266,818 B1 | | 7/2001 | Howland et al. | |
| 6,526,862 B1 | * | 3/2003 | Lyons | 89/36.05 |

* cited by examiner

*Primary Examiner*—John J. Calvert
*Assistant Examiner*—Robert H. Muromoto, Jr.
(74) *Attorney, Agent, or Firm*—Thomas J. Ring; Wildman, Harrold, Allen & Dixon LLP

(57) ABSTRACT

A multi-component stab and ballistic resistant garment having a stab resistant sub-panel constructed of at least one layer of metallic cloth interposed between at least two layers of woven fabric. A ballistic resistant sub-panel constructed of woven ballistic resistant sheets is provided in which at least a portion of the stab resistant sub-panel and at least a portion of the ballistic resistant sub-panel are aligned with one another.

75 Claims, 4 Drawing Sheets

MULTI-COMPONENT STAB AND BALLISTIC RESISTANT GARMENT AND METHOD

CROSS REFERENCE TO RELATED APPLICATION

This application claims the priority from U.S. Provisional Application No. 60/225,553 filed Aug. 16, 2000.

FIELD OF THE INVENTION

This invention relates to body protective garments and more particularly to protective garments which will protect a body from weapons which inflict stab or ballistic wounds.

BACKGROUND OF THE INVENTION

Various stab resistant articles or garments have been worn by prison corrections officers and other types of security, military or law enforcement personnel. Such stab resistant articles are designed to prevent bodily penetration as a result of stabbing or slashing from sharp objects or weapons. Unfortunately, these protective articles were generally rigid shields which were externally worn and were constructed of heavy, bulky and inflexible metal components such as titanium or other extremely hard metal alloys. The metallic composition of these cumbersome external vest shields must be of sufficient thickness, rigidity and strength to stop impacts imparted by an attacker, such as a prison inmate, using a sharp knife, pick, shank or the like.

Disadvantageously, the bulk and rigidity of such metallic vest garments rendered it uncomfortable to wear. Furthermore, it is rather difficult for the wearer of a rigid vest such as a corrections officer to move and maneuver around quickly and easily which is important especially if the wearer is being attacked. The stiffness of these externally worn body shield vests are uncomfortable to wear in a sitting position since the lower edges often press firmly against the stomach, hip and side areas of the wearer, as well as, the top of the shield placing pressure on the wearer's throat and chin areas. Moreover, the weight of such known metallic shields caused significant fatigue to the security personnel wearer over the time for the wearer's working shift. Accordingly, such known puncture resistant articles often prove to be ineffective predominantly due to the fact that the potential wearer prefers not to wear the bulky torso shield rather than tolerating its discomfort.

Another, and perhaps a more significant problem with such rigid metallic alloy puncture resistant vests is that they were not concealable. These known cumbersome shield vests were almost exclusively externally worn and even if they were not worn externally, the bulky nature of such articles make it obvious to a would be attacker that the wearer (corrections officer, etc.) is wearing a protective puncture or stab resistant metallic shield vest. Since the worn vest article cannot be concealed the potential attacker is more prone to stab or slash at a vital area away from the vest such as the lower abdomen, groin, neck or head area. Not only is any element of surprise on the part of the wearer removed by the unconcealed nature of such cumbersome rigid vests, it is highly impractical if not impossible for the undercover personnel to wear such bulky items.

However, significant advancements have been made to construct wearable and concealable soft body armor that protects the wearer from puncture wounds such as found in U.S. Pat. No. 5,960,470 assigned to Second Chance Body Armor, Inc. These puncture resistant garments were intended for that purpose and carried multiple layers of a high density weave or pick and end counts.

Further advancements have been recently made in developing bi-component ballistic and stab resistant wearable and concealable garments. These developments by Second Chance Body Armor, Inc. are described in U.S. Pat. No. 5,960,470. The bi-component garment contains a woven puncture resistant panel constructed of multiple plies of relatively high density woven fabric used in conjunction with a ballistic resistant panel which was constructed of either multiple plies of woven fabric of a relatively lower density weave or composite materials. This versatile bi-component garment provides the wearer with puncture and ballistic resistance protection and concealability along with a level of comfort afforded that construction.

DETAILED DESCRIPTION

Figure 1:
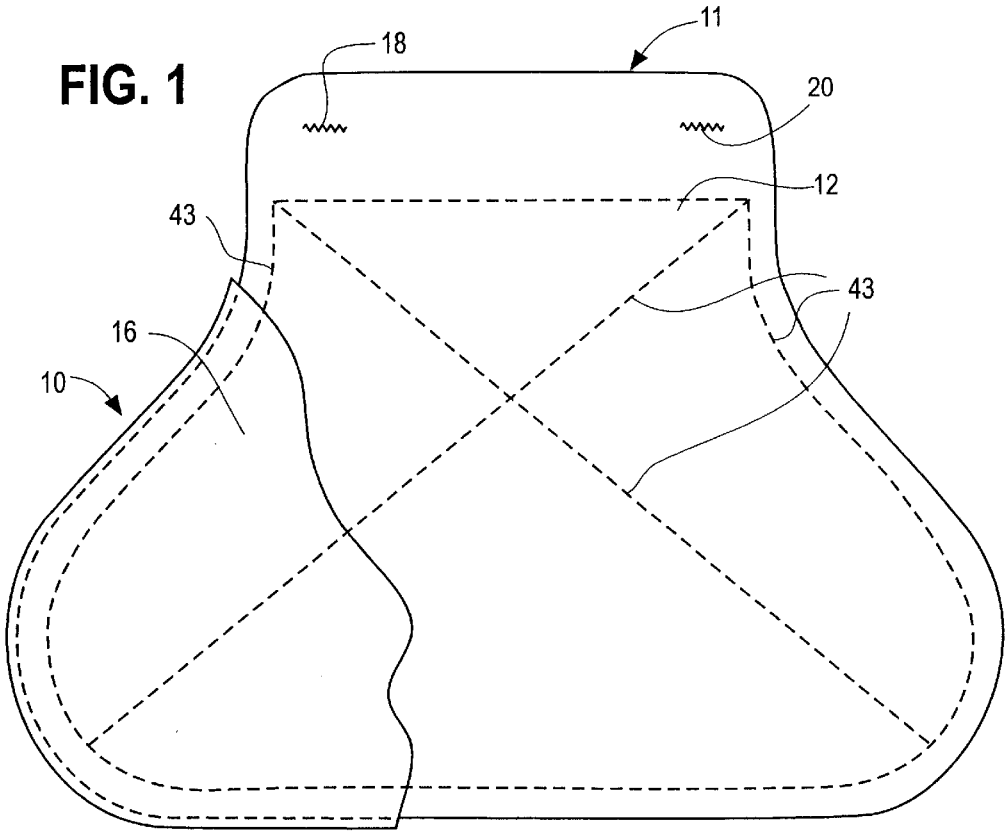
FIG. 1 is a front plan view of a multi-component stab and ballistic resistant garment with a panel assembly cover partially broken away.
Figure 2:
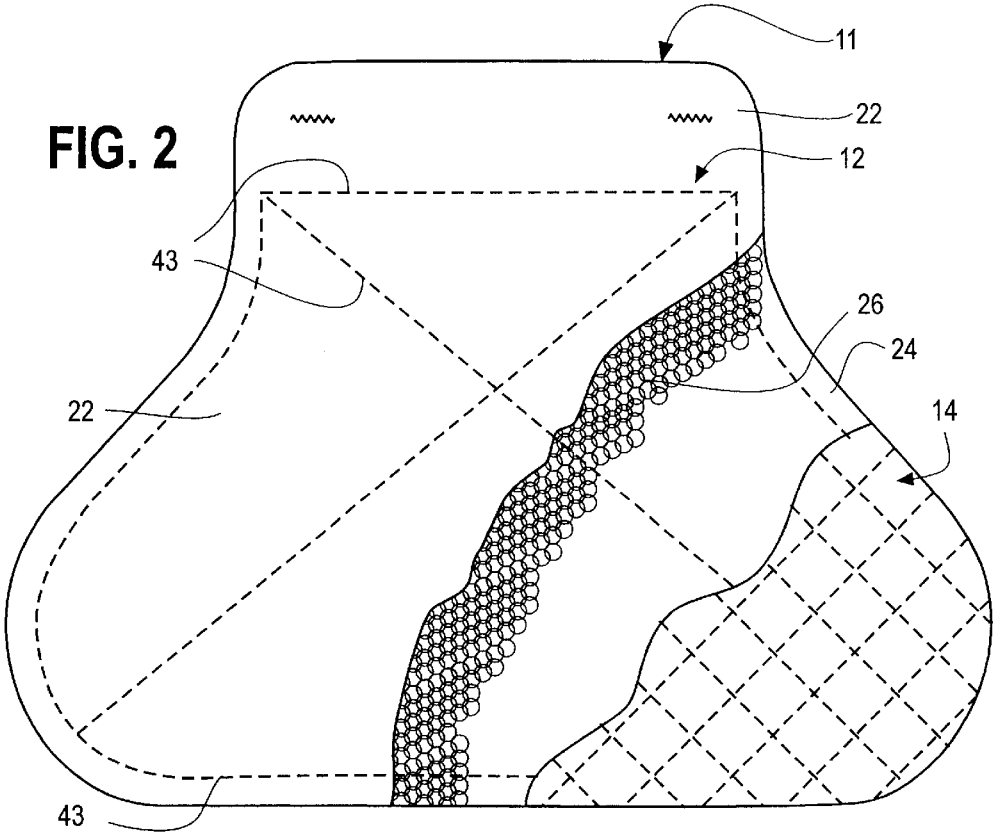
FIG. 2 is the front plan view of FIG. 1 with the panel assembly cover removed and a stab resistant sub-panel partially broken away revealing a ballistic resistant sub-panel.
Figure 3:
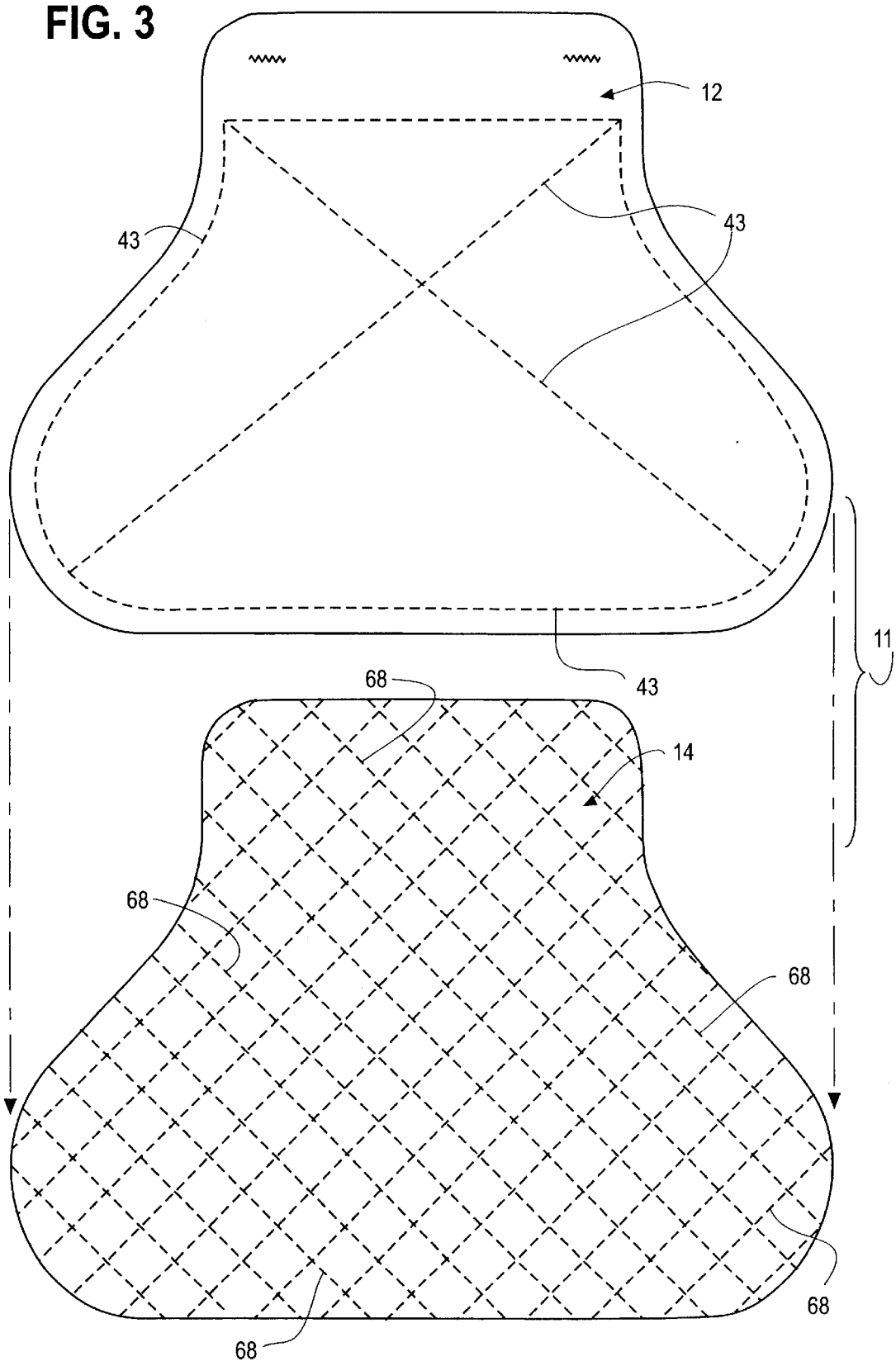
FIG. 3 is an exploded view of FIG. 2 showing the two sub-panels of the multi-component stab and ballistic resistant garment.

Referring to FIGS. 1–3, multi-component stab and ballistic resistant garment 10 is shown having two sub-panels 12 and 14. In this assembly, sub-panel 12 is designed to resist penetration from stab or slash attacks with sharp objects while sub-panel 14 is designed to resist ballistic penetration from discharge of a ballistic weapon or the like. Stab resistant sub-panel 12 is positioned at the strike face of garment 10 and provides this bi-component construction of garment 10 with an enhanced ballistic performance. Ballistic resistant sub-panel 14 is positioned underlying stab resistant sub-panel 12 such as at a body side portion of the garment and provides an enhanced or synergistic performance to the stab resistance of this multi-component construction of garment 10. In the example seen in FIGS. 1–4, the stab resistant sub-panel 12 overlies the ballistic resistant sub-panel 14 forming multi-component stab and ballistic resistant pad 11. As discussed herein, the ballistic resistant sub-panel 14 is constructed of woven ballistic resistant sheets wherein at least a portion of the stab resistant sub-panel and at least a portion of the ballistic resistant sub-panel are aligned with one another.

In FIG. 1, a partially broken away stab and ballistic resistant pad cover 16 is shown which encompasses and encloses sub-panels 12 and 14 of multi-component pad 11. Pad cover 16 is secured snuggly around sub-panels 12 and 14 and is typically stitched around the perimeter to itself. The snug fit of pad cover 16 to sub-panels 12 and 14 assists in providing support to sub-panels 12 and 14 in maintaining alignment of the sub-panels to each other. It is desired to have pad cover 16 provide garment 10 with breathability and protection of the sub-panels from degrading aspects of contaminants such as body oils and salts, fuel spills, soaps, detergents, urine blood and other undesirable contaminants. A selective construction of pad cover 16 would have it constructed of a water proof and vapor permeable material such as GORE-TEX, manufactured by W. L. Gore & Associates, Inc. of Newark, Del. Under such construction, performance integrity of sub-panels 12 and 14 are maintained, longevity is enhanced and desired comfort in the form of moisture vapor breathability is provided to the wearer. Alternatively, panel cover 16 may selectively be constructed of woven nylon material having a plastic coating or White Supplex treated with dynamic water repellent, a highly breathable material formed from nylon fiber by E. I. DuPont de Nemours & Company of Wilmington, Del.

Garment 10 having pad 11 enclosed in pad cover 16 may, in turn, be positioned into a carrier, often constructed of cloth or other common material which is constructed for mounting onto the wearer concealed under the wearer's clothing.

In referring to FIG. 1, sub-panels 12 and 14 are secured together with bar tac lines of stitching 18 and 20. Bar tac stitches 18 and 20 penetrate through both sub-panels 12 and 14 and are positioned toward the top portion of garment 10. This positioning provides flexible stab resistant panel 12 to be suspended to overlie ballistic resistant panel 14. Moreover, since bar tac stitches 18 and 20 penetrate sub-panels 12 and 14, they are strategically positioned proximate the perimeter of the multi-component pad 11 near shoulder areas of the wearer and away from primary locations of stabbing or ballistic impact. Additionally, bar tac stitching 18 and 20 provides assistance in maintaining sub-panels 12 and 14 in alignment to one another optimizing performance of garment 10.

A wide variety of fibers may be selectively used in bar tac stitching 18 and 20 such as rigid-rod lyotropic liquid crystal polymer fiber formed from poly(p-phenylene-2, 6-benzobisoxaxole) (PBO) or as referred to as Zylon a registered trademark of Toyobo Co. Ltd. of Osaka, Japan, aramid fibers such as referred to as Twaron a registered trademark of and manufactured by Acordis, Inc. of Wuppertal, Germany or such as referred to as Kevlar a registered trademark of and manufactured by E. I. DuPont de Nemours & Company of Spruance, Virginia or ultra high molecular weight polyethylene fiber such as referred to as Spectra a registered trademark of and manufactured by Allied Signal & Co. of Morris County, N.J. The denier of these fibers may selectively range from 200 to 1500.

In referring to the example of FIG. 2, stab resistant sub-panel 12 is constructed of three components or layers. The three layers include top layer 22, bottom layer 24 and a metallic cloth layer 26 interposed between layers 22 and 24. Both top layer 22 and bottom layer 24 may selectively comprise one or more sheets or layers of woven fabric. In the present construction, the top and bottom layers 22 and 24 of fabric sheets are each woven with Zylon PBO fiber of 500 denier in a weave of 45 fibers per inch of warp by 45 fibers per inch of weft. Alternatively, a wide range of fibers are contemplated to be selectively used in the weave construction of top and bottom layers 22 and 24 including Zylon PBO, aramid and ultra high molecular weight polyethylene fibers, all of which are described above as a selection of fibers to be selectively used for the bar tac stitching 18 and 20. Likewise, a wide range of deniers for these selective fibers are contemplated from 200 to 1500.

As seen in FIGS. 1–3, top and bottom layers 22 and 24 are constructed to be generally approximately the same size and shape and are secured together, as discussed below, generally in registration with each other.

Figure 4:
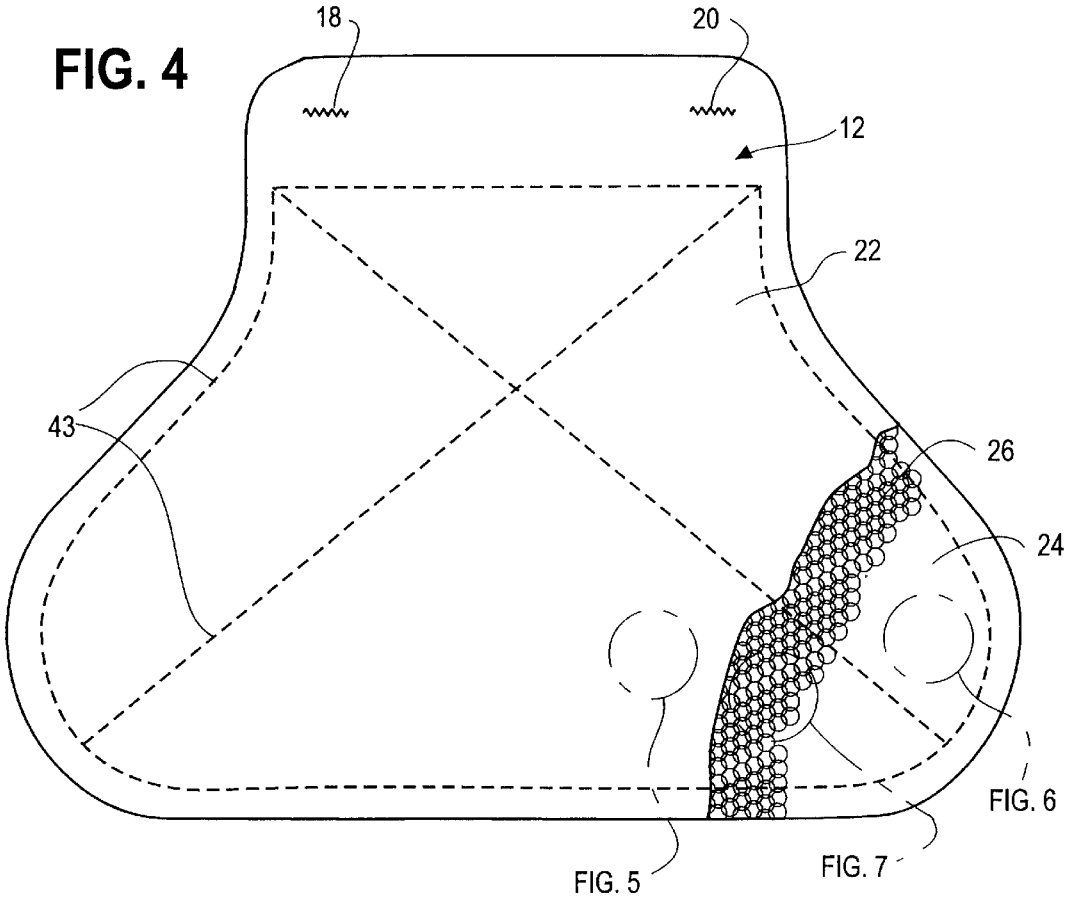
FIG. 4 is a front plan view of the stab resistant sub-panel partially broken away.
Figure 5:
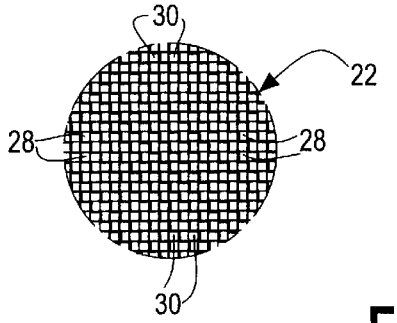
FIG. 5 is an enlarged view of the woven fabric within circle 5 of the front layer of the stab resistant sub-panel of FIG. 4.
Figure 6:
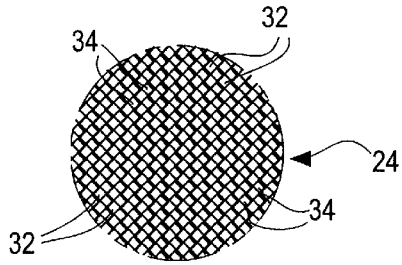
FIG. 6 is an enlarged view of the woven fabric within circle 6 of the back layer of the stab resistant sub-panel of FIG. 4.

An enlarged view of the respective weaves of top and bottom layers 22 and 24 are shown in FIGS. 4, 5 and 6. In FIG. 5, an enlarged view of the plain weave of top layer 22 is shown and similarly, in FIG. 6 an enlarged view of the plain weave of bottom layer 24 is shown. As can be seen in FIG. 5, warp 28 and weft 30 are oriented in a directions of substantially horizontal and substantially vertical respectively. On the other hand, in contrast, the warp 32 and weft 34 of bottom layer 24 are positioned each angularly displaced approximately 45 degrees out of alignment with warp 28 and weft 30 of top layer 22. A sharp object that encounters or comes into contact with top layer 22 of panel 12 through a stabbing or slashing condition engages penetration resistance from the fibers of warp 28 and weft 30. As the weapon proceeds to exert force through the interposing metallic cloth layer 26 and encounters the bottom layer 24, the fibers in warp 32 and weft 34 of bottom layer 24, as seen in FIG. 6, provide penetration resistance. Irrespective of angle of attack of a sharp object, the present invention is providing double the number of directions of fiber alignment, with the nonalignment of the warp and weft between top layer 22 and bottom layer 24, providing more different angles of cut resistance to a blade.

A balanced plain weave is shown in FIGS. 5 and 6, however, it should be understood an imbalanced plain weave may be selectively used and that various other balanced and imbalanced weaves of one to four less picks to warp ends are contemplated to be used such as basket, twill or satin as well as other commonly known weaves. The weaves can be selectively used in the ranges from 20 by 20 to 45 by 45 in fibers per inch in the warp and weft directions whether balanced or imbalanced. Thus, the weave for the layers of woven fabric of the stab resistant sub-panel 12 ranges from 20-45 warp fibers per inch and 20-45 weft fibers per inch.

In one example, warp 28 and weft 30 of top layer 22, FIG. 5, are angularly displaced and therefore not aligned with the corresponding warp 32 and weft 34 of bottom layer 24 as seen in FIG. 6. The angular displacement provides additional directions of penetration resistance for the stabbing and slashing encounters and therefore enhances the effectiveness of the garment. The angular displacement between warp 28 of the top layer 22 and warp 32 of bottom layer 24 can selectively range from 22.5 degrees to 45 degrees and correspondingly, likewise the angular displacement between weft 30 of top layer 22 and weft 38 of bottom layer 24 can selectively range between 22.5 degrees to 45 degrees of angular displacement.

Figure 7:
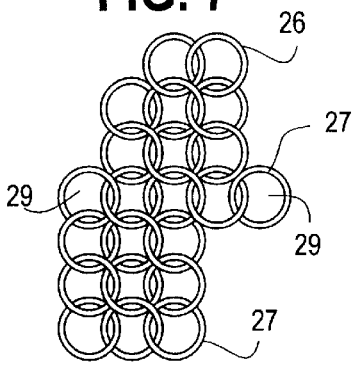
FIG. 7 is an enlarged view of the metallic cloth within circle 7 of the stab resistant sub-panel of FIG. 4.

The third component or layer of stab resistant panel 12 is metallic cloth 26. In referring to FIGS. 2, 4 and 7 metallic cloth 26 is selectively constructed of a layer of No. 9 chain mail constructed of stainless steel fabricated by Whiting & Davis, Inc. of Attleboro Falls, Mass. No. 9 chain mail includes the specifications of a diameter of wire of 0.0311 inches; links, rings or circles of 0.275 inches outside diameter; and a weight of 91 ounces per square yard. Metallic cloth 26, as seen in FIG. 7, in this particular construction of chain mail includes the interlinking of smaller geometric units or circles 27 constructed of strong stainless steel forming a strong flexible cloth having small openings 29 within the cloth. The geometric units 27 interlinked together will resist impact from the stabbing object and will tend to trap and resist penetration of the sharp object within the small openings 29 within its construction.

Alternatively, selective constructions of metallic cloth 26 are contemplated. For instance, a wide range of chain mails may be used that are constructed of stainless steel or titanium and which vary in weight and size such as chain mail Nos. 9 and 5 and the like. For example No. 5 chain mail manufactured by Whiting & Davis have specifications of a diameter of wire of 0.0215 inches; links, rings or circles of 0.160 inches outside diameter and a weight of 83 ounces per square yard.

Additional alternative constructions for metallic cloth layer 26 can be selectively used. These constructions include such metallic cloths as monofilament wire mesh, multi-stranded wire mesh, monofilament knit wire and multi-stranded knit wire. The composition of these wire mesh and knit wire constructions will vary and may include stainless steel or titanium and will vary in weight. Additionally, one or more layers of the metallic cloth can be used in constructing layer 26.

In constructing stab resistant sub-panel 12, one, two or more layers of metallic cloth 26 may be used. In the construction where there are two or more layers of metallic cloth being used, each layer would be positioned to overlie one another. All the layers may be of the same construction or various layers may be formed of different constructions such as chain mail, wire meshes or knit wire.

In stacking metallic cloth layers 26 to overlie one another, a similar approach can be taken as with woven fabrics discussed herein. The woven fabric sheets of top layer 22 or bottom layer 24 may selectively have warps and wefts of successive sheets in angular rotational nonalignment with one another wherein alternating sheets may have their warps and wefts in alignment. The woven fabrics may have groups of sheets of warps and wefts in alignment with one another but adjacent groups of sheets have their warps and wefts in angular rotational nonalignment with one another wherein alternating groups of sheets may have their warps and wefts in alignment with one another. As such, in one example a plurality of top layers and bottom layers may selectively each have groups of at least two layers of woven fabric in which individual layers within each group have warp and weft fibers in alignment with one another. Adjacent groups, having at least two layers, may selectively have the warp and weft fibers of the layers of woven fabric angularly displaced relative to one another. In this example, the warp and weft fibers of the layers of alternating groups, such as every other group, having at least two layers, may be substantially in alignment with one another.

This arrangement of layers may selectively apply to the metallic cloth 26. As seen in the example of FIG. 7, chain mail has a matrix of interlocking circles that generally align in transverse rows similarly to a warp and weft of a fabric, likewise knit wire has a matrix of interlocking loops that generally align in transverse rows similarly to a warp and weft of a fabric and mesh wire includes numerous weaves such as plain, twill and other common weaves which generally form a matrix of fibers similar to a warp and weft of a fabric. In utilizing these various constructions of metallic cloths, the same application of orienting the warps and wefts of layers of the metallic cloth can be applied, as is applied to woven fabrics described herein, wherein their transverse rows or warps and wefts are angularly displaced out of alignment as described above for the woven fabrics. Another configuration of out of alignment warps and wefts for metallic cloth layers may also include generally aligning the warp and weft rows (circles, loops or weaves, etc.) of one metallic cloth sheet with the warp and weft rows of an adjacent and overlying other metallic cloth sheet, wherein the warp and weft rows of the one metallic cloth sheet may be laterally shifted so as to have at least one of one warp row and one weft row of the one metallic sheet overlap two corresponding adjoining warp rows and two corresponding adjoining weft rows, respectively, of the another metallic cloth sheet. Alternatively, the layers of metallic cloth 26 may have their transverse rows or warp and weft positioned in alignment and generally in registration over one another.

As described herein, the multi-component stab and ballistic resistant pad 11 has stab resistant sub-panel 12 constructed of at least one layer of metallic cloth 26 interposed between at least two layers 22 and 24 of woven fabric. Top layer 22 and bottom layer 24 may each comprise one or more layers of woven fabric of high strength fibers. In one example, as discussed herein, a plurality of top layers 22 of woven fabric are placed in overlying relationship at a strike side of the stab resistant sub-panel 12 and a plurality of bottom layers 24 of woven fabric are placed in overlying relationship at a side opposite the strike side of the stab resistant sub-panel with the metallic cloth interposed between the top layers and bottom layers of woven fabric.

Referring now to FIGS. 1–3, stitches 43 are used to secure all three components or layers 22, 24 and 26 together forming stab resistant panel 12. Additionally, stitches 43 maintain metallic cloth layer 26 in a generally flat and secure position within panel 12. Stitches 43 pass through layer 22, metallic cloth 26 and bottom layer 24 securing all three components together. Stitches 43 follow a pattern proximate to the perimeter of metallic cloth 26 and perimeter of layers 22 and 24. Stitches 43 pass through top layer 22 and through metallic cloth 26 and through bottom layer 24 securing the proximate perimeter of metallic cloth 26 to an area approximate to the perimeters of both layers 22 and 24 of panel 12. To further secure metallic cloth 26 within panel 12 and maintain its flexible structure in a substantially flat position within panel 12, stitches 43 are positioned in a cross pattern over panel 12 and through panel 12, as seen in FIGS. 1–3. In the cross pattern formed by stitches 43, one row of stitches 43 are positioned from an upper right hand location of metallic cloth 26 and layers 22 and 24 to a lower left hand location of the metallic cloth 26 and layers 22 and 24. Similarly, another row of stitches 43 are positioned from an upper left hand location of metallic cloth 26 and layers 22 and 24 to a lower right hand location of metallic cloth 26 and layers 22 and 24.

Now referring to the ballistic panel 14, as seen in FIGS. 3 and 8–11, this panel is constructed of multiple plies or sheets of woven ballistic resistant material. In one example embodiment, ballistic panel 14 selectively has 32 sheets, plies or layers 47, as representatively shown in FIG. 11, with each ply, layer or sheet constructed of Zylon PBO fiber of 500 denier and is woven in an imbalanced weave of 25 by 24 fibers per inch in the warp and weft directions, respectively. A wide range of fibers are contemplated to be selectively used in the weave construction of the sheets or plies 47 in panel 14 including PBO, aramid and ultra high molecular weight polyethylene fibers as described above for fibers used for bar tacs 18 and 20. Additionally, a wide range of sheets 47 for constructing panel 14 may selectively be employed, ranging from 18 to 42 in number. Likewise, a wide range of deniers for these fibers are selectively contemplated from 200 to 1500. As seen in FIGS. 5 and 6 and FIGS. 9 and 10, the layers of woven fabric 22, 24 of the stab resistant sub-panel 12 have weave which is tighter than the weave for the sheets 47 of the ballistic resistant sub-panel. In this embodiment, a higher number of warp fibers 28, 32 and weft fibers 30, 34 per inch, FIGS. 5 and 6, are employed in the layers 22, 24 of woven fabric for the stab resistant sub-panel 12 than the warp fibers 50, 54 and weft fibers 52, 56 per inch, FIGS. 9 and 10, employed in the ballistic resistant sheets 47 such that the woven fabric layers of sub-panel 12 have a tighter weave than the weave in the ballistic resistant sheets of sub-panel 14.

An imbalanced plain weave may be utilized in the sheets of ballistic resistant sub-panel 14. A balanced plain weave may also be selectively used as could a wide variety of imbalanced and balanced weaves. An imbalanced weave having one to four less picks (weft fibers), than warp ends per inch are contemplated to be selectively used as are basket, twill or satin as well as other commonly known weaves. These weaves can range from 20 by 20 to 45 by 45 in fibers per inch in the warp and weft directions whether balanced or imbalanced.

Figure 8:
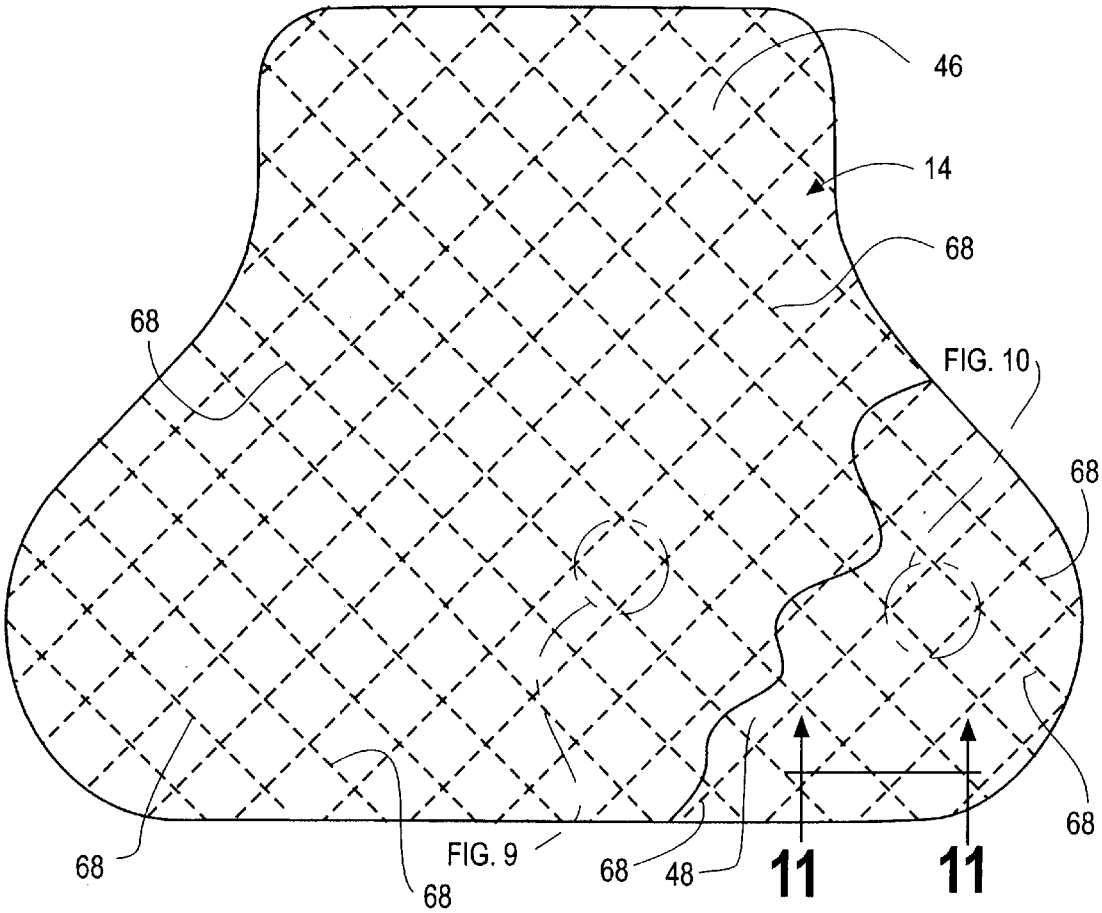
FIG. 8 is a partially broken away front plan view of the ballistic resistant sub-panel of the bi-component garment.
Figure 9:
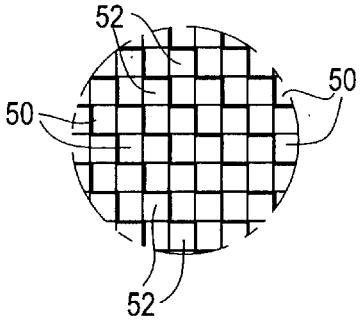
FIG. 9 is an enlarged view of the woven fabric within circle 9 of a front layer of the ballistic resistant sub-panel of FIG. 8.
Figure 10:
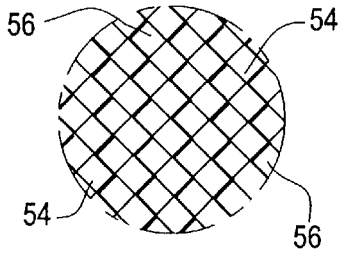
FIG. 10 is and enlarged view of the woven fabric within circle 10 of a second layer of the ballistic resistant sub-panel of FIG. 8.

In referring to FIG. 8, a first sheet 46 and a second underlying sheet 48 is shown. It is understood that sheets 47 in panel 14 will all be substantially the same size and shape and overlie one another generally in registration with one another. An enlarged view of the respective weaves of first sheet 46 and second underlying and adjacent sheet 48 are shown in FIGS. 9 and 10, respectively. As can be seen in FIG. 9, warp fibers 50 and weft fibers 52 are oriented in a direction of substantially horizontal and substantially vertical, respectively. On the other hand, in contrast, the warp fibers 54 and weft fibers 56 of second or underlying sheet 48, as seen in FIG. 10, are positioned each angularly displaced approximately 45 degrees out of alignment with the warp 50 and weft 52 of first sheet 46. A knife, blunt force or ballistic impact onto or through to ballistic resistant sub-panel 14 provides a dispersement of energy along warp 50 and weft 52 in FIG. 9 and along warp 54 and weft 56 directions in FIG. 10. This angularly displaced warp and weft of adjacent successive sheets 46 and 48 provide double the number of directions of alignment of fibers thereby significantly enhancing dispersement of the knife, blunt force or ballistic impact energy.

It should be understood that the absolute orientation of the warp and weft of the above described woven sheets 46 and 48 is not a necessary criteria for this construction. The important matter in this construction is that warp 50 and weft 52 of sheet 46 are angularly displaced from the corresponding warp 54 and weft 56 of adjacent sheet 48. The angular displacement provides additional directions of for dispersal of energy at the time of a ballistic impact and enhances the knife, blunt force or protective resistant capabilities. The angular displacement between warp 50 of sheet 46 and warp 54 of sheet 48 can selectively range from 22.5 degrees to 45 degrees and correspondingly, likewise the angular displacement between weft 52 of sheet 46 and weft 56 of sheet 48 can selectively range from 22.5 degrees to 45 degrees.

In the present construction, with regard to the multiple sheets 47 that comprise panel 14, each successive sheet 47 has their warp and weft angulary displaced and therefore out of alignment with the warp and weft of the sheet 47 to which it is adjacent. The adjacent sheets 47 in panel 14 are oriented as described above for sheets 46 and 48 in which the respective warp and wefts of each of the sheets are angularly displaced from one another. The next adjacent underlying sheet from sheet 48 will have its warp and weft angulary displaced from the warp and weft of sheet 48, however, its warp and weft can be aligned with the warp and weft of sheet 46. Thus, each successive sheet within panel 14 will have a different alignment of warp and weft to its immediately adjacent sheets positioned on either side of it, however, this construction would permit having each alternating sheet 47 within panel 14 have the same alignment of warps and wefts and each adjacent sheet 47 have their warps and wefts angularly displaced and therefore not aligned with one another.

Similarly, the construction of panel 14 can have a group of at least two successive sheets 47 with their warps and wefts in alignment to one another and then have the following or second group of at least two successive sheets in the panel have their warps and wefts in alignment with one another but angularly displaced and therefore out of alignment with the warps and wefts of the preceding group of at least two sheets. This second group of at least two sheets is then followed by another (or third) group of at least two more ballistic resistant sheets with their warps and wefts in the weaves of the individual ones of the ballistic resistant sheets in alignment with one another but angularly displaced from the warps and wefts of the immediately preceding or second group of at least two sheets. This pattern would continue throughout panel 14. This construction, similarly to the above described alignment of warps and wefts of alternating sheets arrangement, can include the alignment of warps and wefts of the sheets within alternating groups of at least two sheets with, each adjacent group of at least two sheets having their warps and wefts angularly displaced and therefore out of alignment to the warps and wefts of the adjacent group of at least two sheets.

Figure 11:
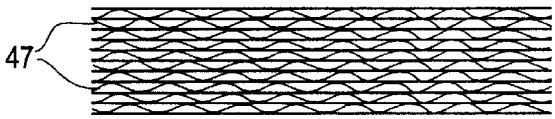
FIG. 11 is a cross sectional view as seen along line 11—11 in FIG. 8.

As seen in FIGS. 2, 3 and 8, multiple sheets 47, as seen in FIG. 11, are secured together with stitches 68. Stitches 68 will penetrate through all sheets 47 of panel 14. As discussed earlier for bar tac stitches 18 and 20, the selection of fibers for stitching 68 will likewise vary in composition such as PBO, aramid and ultra high molecular weight polyethylene with deniers varying from 200 to 1500.

Stitches 68 are positioned into a pattern on and through layers 66 across panel 14. Stitches 68 have rows of stitches aligned in one direction and rows of stitches aligned in another crossing direction to form a quilt pattern as seen in FIGS. 2, 3 and 8. Stitches 68 are stitched to be approximately four to ten stitches to an inch. Other patterns are contemplated to be selectively used, such as a box pattern in which stitches 68 form rows of boxes across panel 12. Other patterns include a diamond pattern in which rows of diamonds, in which one axis is longer than the other, are formed across panel 12. The patterns will vary in size. The distance between adjacent parallel lines of stitches that form these patterns can be spaced apart from 1.0 inch to 4.5 inches apart.

The above described multi-component stab and ballistic resistant garment 10 has been designed and constructed to meet certain levels of ballistic and stab resistance performance of PSDB (Police Scientific Development Branch) Ballistic Body Armor Standard (1995) and the PSDB Stab Resistance Standard For Body Armor (1999) of the Home Office Police Department of the United Kingdom. The certain levels of ballistic and stab performance for garment 10 include HG1—Low Handgun in conjunction with KR1 (Knife Resistance) stab resistance level and HG1—Low Handgun in conjunction with KR2 stab resistance level.

Garment 10 is constructed to be at or under 1.4 pounds/sq.ft. and meet the HG1 in conjunction with KR2 standards identified above. Additionally, garment 10 is constructed to be at or under 1.3 pounds/sq.ft. and meet the HG1 in conjunction with KR1 standards identified above.

The method of assembling garment 10 will includes angularly displacing the warps and wefts of layers 22 and 24 out of alignment with one another as described hereinabove. Metallic cloth layer 26 is interposed and lain flat in between layers 22 and 24. Layers 22, 26 and 24 are stitched together with stitches 43 as described hereinabove, for the stab resistant sub-panel 12.

In fabricating ballistic resistant sub-panel 14, overlie sheets of woven ballistic resistant material as described above. Orient the warp and wefts of each successive sheet 47 of panel 14 or each successive group of at least two sheets of panel 14 in accordance with what has been described hereinabove. Secure woven sheets 47 together with a selected pattern of stitches 68 as described above, forming ballistic resistant panel 14.

With stab resistant panel 12 and ballistic resistant panel 14 constructed, both panels 12 and 14 are secured together with bar tac stitches 18 and 20. Selectively, a water proof and vapor permeable pad cover 16 is secured about panels 12 and 14. With pad cover 16 engaged about panels 12 and 14 garment 10 can be secured or positioned into a carrier for mounting to the wearer.

Although certain embodiments have been depicted and described in detail herein, it will be apparent to those skilled in the relevant art that various modifications, additions, substitutions and the like can be made without departing from the spirit of the invention and these are therefore considered to be within the scope of the invention which is defined by the appended claims and their equivalents.

We claim:

1. A multi-component stab and ballistic resistant garment, comprising:

a stab resistant sub-panel constructed of at least one layer of metallic cloth interposed between at least two layers of woven fabric in which the layers of woven fabric of the stab resistant sub-panel have a weave of warp and weft fibers;

a ballistic resistant sub-panel in which at least a portion of the stab resistant sub-panel and at least a portion of the ballistic resistant sub-panel are aligned with one another, and the ballistic resistant sub-panel is constructed of a plurality of woven ballistic resistant sheets which have a weave of warp and weft fibers, said weave of the layers of woven fabric of the stab resistant sub-panel being tighter than the weave of the sheets of the ballistic resistant sub-panel such that a higher number of warp and weft fibers per inch are employed in the layers of woven fabric of the stab resistant sub-panel than the warp and weft fibers per inch employed in the ballistic resistant sheets.

2. The garment of claim 1 in which the stab resistant sub-panel overlies the ballistic resistant sub-panel forming a multi-component pad.

3. The garment of claim 2 in which the stab resistant sub-panel is positioned at a strike side portion of the multi-component pad and the ballistic resistant sub-panel is positioned at a body side portion of the multi-component pad.

4. The garment of claim 3 in which the stab resistant sub-panel is secured by stitches to the ballistic resistant sub-panel.

5. The garment of claim 3 in which the stitches which secure the stab resistant sub-panel to the ballistic resistant sub-panel are bar tac stitches positioned proximate the perimeter of the multi-component pad.

6. The garment of claim 1 in which the at least one layer of metallic cloth is secured to the at least two layers of woven fabric.

7. The garment of claim 6 in which a plurality of stitches positioned proximate a perimeter of the metallic cloth, a perimeter of a top layer of woven fabric and a bottom layer of woven fabric secure the top layer, bottom layer and metallic cloth together.

8. The garment of claim 7 in which the stab resistant sub-panel has a cross pattern of stitches which secure the top layer, bottom layer and metallic cloth together, said cross pattern having one row of stitches which extend from an upper right location to a lower left location of the stab resistant sub-panel and another row of stitches which extend from an upper left location to a lower right location of the stab resistant sub-panel.

9. The garment of claim 1 in which the stab resistant sub-panel and the ballistic resistant sub-panel are secured to one another.

10. The garment of claim 1 in which the at least one layer of metallic cloth is selected from the group of (a) chain mail, (b) wire mesh, and (c) knit wire.

11. The garment of claim 1 in which the at least one layer of metallic cloth has a plurality of geometric units interlinked together.

12. The garment of claim 11 in which the metallic cloth is flexible and the geometric units are interlinked together through generally circular openings in the units.

13. The garment of claim 11 in which the geometric units are formed of one of (a) stainless steel and (b) titanium.

14. The garment of claim 1 in which the stab resistant sub-panel has a plurality of layers of metallic cloth with each layer of cloth positioned to overlie one another.

15. The garment of claim 14 in which the plurality of layers of metallic cloth are each formed of one of (a) chain mail, (b) wire mesh or (c) knit wire.

16. A multi-component stab and ballistic resistant garment, comprising:

a stab resistant sub-panel constructed of a plurality of layers of metallic cloth with each layer of cloth positioned to overlie one another in which the layers of metallic cloth are interposed between at least two layers of woven fabric and in which at least two of the plurality of layers of metallic cloth are formed of different constructions selected from the group of (a) chain mail, (b) wire mesh and (c) knit wire; and a ballistic resistant sub-panel in which at least a portion of the stab resistant sub-panel and at least a portion of the ballistic resistant sub-panel are aligned with one another.

17. The garment of claim 1 in which the weave for the layers of woven fabric of the stab resistant sub-panel ranges from 20–45 warp fibers per inch and 20–45 weft fibers per inch.

18. The garment of claim 17 in which the layers of woven fabric of the stab resistant sub-panel are formed from rigid-rod lyotropic liquid crystal polymer fibers.

19. The garment of claim 17 in which the layers of woven fabric of the stab resistant sub-panel are formed from fibers of one of (a) poly (p-phenylene-2,6-benzobisoxazole) (PBO), (b) aramid, and (c) ultra high molecular weight polyethylene.

20. The garment of claim 1 in which the at least two layers of woven fabric of the stab resistant sub-panel includes a top layer of woven fabric having warp and weft fibers and a bottom layer of woven fabric having warp and weft fibers.

21. The garment of claim 20 in which the warp and weft fibers of the top layer are angularly displaced from the warp and weft fibers of the bottom layer of woven fabric for the stab resistant sub-panel.

22. The garment of claim 21 in which the angular displacement of the warp and weft fibers of the top layer relative to the warp and weft fibers of the bottom layer ranges from 22.5 degrees to 45 degrees.

23. The garment of claim 21 in which the at least one layer metallic cloth is selected from the group of (a) chain mail, (b) wire mesh, and (c) knit wire.

24. The garment of claim 23 in which the at least one layer of metallic cloth has a plurality of geometric units interlinked together in which the geometric units are formed from one of (a) stainless steel and (b) titanium.

25. The garment of claim 21 in which the plurality of woven ballistic resistant sheets includes one sheet having a weave of warp and weft fibers and a successive sheet having a weave of warp and weft fibers in which the warp and weft fibers of the weave of the one sheet are angularly displaced relative to the warp and weft fibers of the weave of the successive sheet.

26. The garment of claim 25 in which the one sheet is adjacent to the successive sheet in the ballistic resistant sub-panel.

27. The garment of claim 21 in which the angular displacement of the warp and weft fibers of the one sheet relative to the warp and weft fibers of the successive sheet ranges from 22.5 to 45 degrees.

28. The garment of claim 21 in which the ballistic resistant sub-panel comprises a first group of at least two successive woven ballistic resistant sheets in which a warp and a weft for individual ones of the successive woven ballistic resistant sheets of the first group are substantially in alignment to one another and a second group of at least another two successive woven ballistic resistant sheets in which a warp and a weft for individual ones of the woven ballistic resistant sheets of the second group are substantially in alignment to one another and are angularly displaced from the warp and the weft of the woven sheets of the first group.

29. The garment of claim 28 in which the ballistic resistant sub-panel includes a third group positioned adjacent to the second group in which the third group has at least two successive woven ballistic resistant sheets in which a warp and a weft of a weave for individual ones of the woven ballistic resistant sheets of the third group are substantially in alignment to one another and are angularly displaced relative to the warp and weft of the woven sheets of the second group.

30. The garment of claim 20 in which the top layer is positioned at a strike side of the stab resistant sub-panel.

31. The garment of claim 20 including a plurality of top layers of woven fabric placed in overlying relationship at a strike side of the stab resistant sub-panel and a plurality of bottom layers of woven fabric placed in overlying relationship at a side opposite the strike side of the stab resistant sub-panel in which the metallic cloth is interposed between the plurality of top layers and the plurality of bottom layers.

32. The garment of claim 31 in which the plurality of top layers and the plurality of bottom layers each have groups of at least two layers of woven fabric in which individual layers within each group have warp and weft fibers in alignment with one another.

33. The garment of claim 32 in which adjacent groups, having at least two layers, have the warp and weft fibers of the layers of woven fabric angularly displaced relative to one another.

34. The garment of claim 33 in which the warp and weft fibers of the layers of alternating groups, having at least two layers, are substantially in alignment with one another.

35. The garment of claim 1 in which the ballistic resistant sub-panel is constructed of a plurality of woven ballistic resistant sheets in which the ballistic resistant sub-panel has from eighteen to forty-two sheets.

36. The garment of claim 35 in which the woven ballistic resistant sheets are formed of woven fibers of one of (a) poly (p-phenylene-2,6-benzobisoxazole) (PBO), (b) aramid, and (c) ultra high molecular weight polyethylene.

37. The garment of claim 35 in which the woven ballistic resistant sheets of the ballistic resistant sub-panel are stitched together with rows of stitches generally aligned in one direction and with rows of stitches generally aligned in another direction forming one of (a) a quilt stitch pattern and (b) a box stitch pattern.

38. The garment of claim 37 in which the woven ballistic resistant sheets have an imbalanced weave with one to four more warp fibers per inch than weft fibers per inch in the weave.

39. The garment of claim 37 in which the ballistic resistant sub-panel includes one woven ballistic resistant sheet having a weave of warp and weft fibers which are angularly displaced relative to a weave of warp and weft fibers of an adjacent successive woven ballistic resistant sheet of the ballistic resistant sub-panel.

40. The garment of claim 39 in which the angular displacement of the warp and weft fibers of the one woven ballistic resistant sheet relative to the warp and weft fibers of the adjacent successive sheet ranges from 22.5 degrees to 45 degrees.

41. A method of producing a multi-component stab and ballistic resistant garment, comprising the steps of:

providing a stab resistant sub-panel with at least one layer of metallic cloth interposed between at least two layers of woven fabric;

providing the layers of woven fabric of the stab resistant sub-panel to have a weave of warp and weft fibers;

constructing a ballistic resistant sub-panel with a plurality of woven ballistic resistant sheets;

providing the layers of woven ballistic resistant sheets of the ballistic resistant sub-panel with a weave of warp and weft fibers;

providing the weave of the layers of the stab resistant sub-panel to be tighter than the weave of the sheets of the ballistic resistant sub-panel such that a higher number of warp and weft fibers per inch are employed in the layers of woven fabric of the stab resistant sub-panel than the warp and weft fibers per inch employed in the ballistic resistant sheets; and aligning at least a portion of the stab resistant sub-panel and at least a portion of the ballistic resistant sub-panel with one another.

42. The method of claim 41 further comprising overlying the stab resistant sub-panel relative to the ballistic resistant sub-panel to form a multi-component pad.

43. The method of claim 42 further comprising positioning the stab resistant sub-panel at a strike side portion of the multi-component pad, and positioning the ballistic resistant sub-panel at a body side portion of the multi-component pad.

44. The method of claim 43 further comprising securing the stab resistant sub-panel by stitches to the ballistic resistant sub-panel.

45. The method of claim 41 further comprising securing the at least one layer of metallic cloth to the at least two layers of woven fabric.

46. The method of claim 45 further comprising providing a plurality of stitches positioned proximate to a perimeter of the metallic cloth, a perimeter of a top layer of woven fabric and a bottom layer of woven fabric to secure the top layer, bottom layer and metallic cloth together.

47. The method of claim 45 further comprising securing the stab resistant sub-panel and the ballistic resistant sub-panel to one another.

48. The method of claim 41 further comprising selecting the at least one layer of metallic cloth from the group of (a) chain mail, (b) wire mesh, and (c) knit wire.

49. The method of claim 41 further comprising providing the metallic cloth with a plurality of geometric units interlinked together through generally circular openings in the units.

50. The method of claim 41 further comprising positioning a plurality of layers of metallic cloth of the stab resistant sub-panel to overlie one another.

51. The method of claim 50 further comprising forming the plurality of layers of metallic cloth of at least one of (a) chain mail, (b) wire mesh or (c) knit wire.

52. A method of producing a multi-component stab and ballistic resistant garment, comprising the steps of:

providing a stab resistant sub-panel with a plurality of layers of metallic cloth interposed between at least two layers of woven fabric;

positioning the plurality of layers of metallic cloth of the stab resistant sub-panel to overlie one another;

providing at least two of the plurality of layers of metallic cloth with different constructions selected from the group of (a) chain mail, (b) wire mesh, and (c) knit wire;

constructing a ballistic resistant sub-panel with a plurality of woven ballistic resistant sheets; and aligning at least a portion of the stab resistant sub-panel and at least a portion of the ballistic resistant sub-panel with one another.

53. The method of claim 41 further comprising providing the weave for the layers of woven fabric of the stab resistant sub-panel to range from 20–45 warp fibers per inch and 20–45 weft fibers per inch.

54. The method of claim 53 further comprising forming the layers of woven fabric of the stab resistant sub-panel from rigid-rod lyotropic liquid crystal polymer fibers.

55. The method of claim 53 further comprising forming the layers of woven fabric of the stab resistant sub-panel from fibers of one of (a) poly(p-pheynlene-2,6-benzobisoxazole) (PBO), (b) aramid, and (c) ultra high molecular weight polyethylene.

56. The method of claim 41 further comprising providing the at least two layers of woven fabric of the stab resistant sub-panel with a top layer of woven fabric having warp and weft fibers and a bottom layer of woven fabric having warp and weft fibers.

57. The method of claim 56 further comprising angularly displacing the warp and weft fibers of the top layer from the warp and weft fibers of the bottom layer of woven fabric for the stab resistant sub-panel.

58. The method of claim 57 further comprising providing the angular displacement of the warp and weft fibers of the top layer relative to the warp and weft fibers of the top layer relative to the warp and weft fibers of the bottom layer to range from 22.5 degrees to 45 degrees.

59. The method of claim 57 further comprising selecting the at least one layer of metallic cloth from the group of (a) chain mail, (b) wire mesh and (c) knit wire.

60. The method of claim 57 further comprising providing the plurality of woven ballistic resistant sheets to have at least one sheet having a weave of warp and weft fibers and a successive sheet having a weave of warp and weft fibers in which the warp and weft of the weave of the one sheet are angularly displaced relative to the warp and weft fibers of the weave of the successive sheet.

61. The method of claim 60 further comprising placing the one sheet to be adjacent to the successive sheet of the ballistic resistant sub-panel.

62. The method of claim 60 further comprising providing the angular displacement of the warp and weft fibers of the one sheet relative to the warp and weft fibers of the successive sheet to range from 22.5 degrees to 45 degrees.

63. The method of claim 59 further comprising providing the ballistic resistant sub-panel with a first group of at least two successive woven ballistic resistant sheets in which a warp and a weft for individual ones of the successive woven ballistic resistant sheets of the first group are substantially in alignment to one another, and providing a second group of at least another two successive woven ballistic resistant sheets in which a warp and a weft for individual ones of the woven ballistic resistant sheets of the second group are substantially in alignment to one another and are angularly displaced from the warp and the weft of the woven sheets of the first group.

64. The method of claim 63 further comprising positioning a third group of ballistic resistant sheets adjacent to the second group in which the third group has at least two successive woven ballistic resistant sheets in which a warp and a weft of a weave for individual ones of the woven ballistic resistant sheets of the third group are substantially in alignment to one another and are angularly displaced relative to the warp and weft of the woven sheets of the second group.

65. The method of claim 56 comprising positioning the top layer at a strike side of the stab resistant sub-panel.

66. The method of claim 56 further comprising placing a plurality of top layers of woven fabric in overlying relationship at a strike side of the stab resistant sub-panel, placing a plurality of bottom layers of woven fabric in overlying relationship at a side opposite the strike side of the stab resistant sub-panel, and positioning the metallic cloth between the plurality of top layers and the plurality of bottom layers.

67. The method of claim 66 further comprising providing the plurality of top layers and the plurality of bottom layers to each have groups of at least two layers of woven fabric in which individual layers within each group have warp and weft fibers in alignment with one another.

68. The method of claim 67 further comprising positioning adjacent groups, having at least two layers, to have the warp and weft fibers of the layers of woven fabric angularly displaced relative to one another.

69. The method of claim 68 further comprising positioning the warp and weft fibers of the layers of alternating groups, having at least two layers, to be substantially in alignment with one another.

70. The method of claim 41 further comprising ranging the number of woven ballistic resistant sheets in the ballistic resistant sub-panel to be from eighteen to forty-two sheets.

71. The method of claim 70 further comprising providing the woven ballistic resistant sheets to be formed of woven fibers of one of (a) poly (p-phenylene-2,6-benzobisoxazole) (PBO), (b) aramid, and (c) ultrahigh molecular weight polyethylene.

72. The method of claim 70 further comprising stitching together the woven ballistic resistant sheets of the ballistic resistant sub-panel with rows of stitches generally aligned in one direction and with rows of stitches generally aligned in another direction forming one of (a) a quilt stitch pattern and (b) a box stitch pattern.

73. The method of claim 72 further comprising providing the woven ballistic resistant sheets to have an imbalanced weave with one to four more weft fibers per inch than weft fibers per inch in the weave.

74. The method of claim 72 further comprising providing the ballistic resistant sub-panel to have at least one woven ballistic resistant sheet with a weave of warp and weft fibers which are angularly displaced relative to a weave of warp and weft fibers of an adjacent successive woven ballistic resistant sheet of the ballistic sub-panel.

75. The method of claim 74 further comprising angularly displacing the warp and weft fibers of the one woven ballistic resistant sheet relative to the warp and weft fibers of the adjacent successive sheet to establish an angular displacement ranging from 22.5 degrees to 45 degrees.

* * * * *

UNITED STATES PATENT AND TRADEMARK OFFICE

CERTIFICATE OF CORRECTION

PATENT NO. : 6,684,404 B2 
DATED : February 3, 2004
INVENTOR(S) : Thomas E. Bachner, Jr. and Mark S. Pickett It is certified that error appears in the above-identified patent and that said Letters Patent is hereby corrected as shown below:

Column 9,
Line 10, change "will" to -- which --.

Column 14,
Line 1, delete "relative to the warp and weft fibers of the top layer".

Signed and Sealed this

Eighth Day of November, 2005

JON W. DUDAS
*Director of the United States Patent and Trademark Office*